US005948607A

United States Patent [19]

Uchida et al.

[11] Patent Number: 5,948,607

[45] Date of Patent: Sep. 7, 1999

[54] SILVER HALIDE COLOR PHOTOGRAPHIC LIGHT-SENSITIVE MATERIAL

[75] Inventors: Osamu Uchida; Kozo Sato; Toshio Kawagishi; Akira Ikeda, all of Minami Ashigara, Japan

[73] Assignee: Fuji Photo Film Co., Ltd., Kanagawa, Japan

[21] Appl. No.: 08/932,963

[22] Filed: Sep. 18, 1997

[30] Foreign Application Priority Data

Sep. 18, 1996 [JP] Japan ..... 8-246421
Dec. 2, 1996 [JP] Japan ..... 8-321735

[51] Int. Cl.[6] ..... G03C 7/32

[52] U.S. Cl. ..... 430/543; 430/553; 430/555; 430/557; 430/558

[58] Field of Search ..... 430/543, 553, 430/555, 557, 558

[56] References Cited

FOREIGN PATENT DOCUMENTS

| | | |
|---|---|---|
| 08201998 | 8/1996 | Japan . |
| 08201999 | 8/1996 | Japan . |
| 778089 | 7/1957 | United Kingdom . |
| 875470 | 8/1961 | United Kingdom . |

*Primary Examiner*—Janet Baxter
*Assistant Examiner*—Amanda C. Walke
*Attorney, Agent, or Firm*—Birch, Stewart, Kolasch & Birch, LLP

[57] ABSTRACT

A silver halide color photographic light-sensitive material comprising a support having provided thereon at least one silver halide emulsion layer, wherein the silver halide color photographic light-sensitive material contains at least one dye forming coupler represented by the following formula (I):

(I)

wherein $R_1$ represents a substituted or unsubstituted aliphatic group, a substituted or unsubstituted aromatic group, a substituted or unsubstituted heterocyclic group, a substituted or unsubstituted alkoxy group, a substituted or unsubstituted aryloxy group, a substituted or unsubstituted alkylthio group, a substituted or unsubstituted arylthio group or a substituted or unsubstituted amino group; X=Y represents C=O, C=$NR_2$, P=O or S=O; $R_2$ represents an aliphatic group or an aromatic group; Z represents a group capable of being released upon a reaction with the oxidation product of a developing agent; m and n each represents an integer of 1 or 2; $R_1$ and $R_2$, $R_1$ and Z or $R_2$ and Z may be combined with each other to form a ring; and when m is 2, two $R_1$'s may be the same or different, or may be combined with each other to form a ring.

The dye forming coupler represented by the formula (I) provides a yellow dye having excellent hue, a large molecular extinction coefficient and storage stability, and the silver halide color photographic light-sensitive material containing the yellow dye forming coupler is excellent in color reproducibility, sharpness and color image fastness.

15 Claims, 1 Drawing Sheet

SILVER HALIDE COLOR PHOTOGRAPHIC LIGHT-SENSITIVE MATERIAL

FIELD OF THE INVENTION

The present invention relates to a silver halide color photographic light-sensitive material containing a novel dye forming coupler.

BACKGROUND OF THE INVENTION

A color image is formed from dyes having three primary colors of yellow, magenta and cyan according to a subtractive color process in a silver halide color photographic light-sensitive material. In a color photographic method using a conventional p-phenylenediamine color developing agent, a β-acylacetanilide compound has been employed for a long period of time as a yellow coupler. However, since the hue of a yellow dye formed from such a coupler has a reddish tint, it is difficult to obtain a yellow color of good purity. Also, because the dye has a small molecular extinction coefficient, a large amount of the coupler and silver halide are required in order to obtain the desired color density. Thus, a thickness of a layer in a photographic light-sensitive material increases and sharpness of color image formed decreases. Further, the dye tends to decompose under conditions of high temperature and high humidity, and there is a problem in preservability of the color image after development processing.

In order to solve these problems, various investigations have been made on improvements in the acyl group and the anilide group. Recently, 1-alkylcyclopropanecarbonylacetanilide compounds as described in JP-A-4-218042 (the term "JP-A" as used herein means an "unexamined published Japanese patent application") and cyclic malondiamide compounds as described in JP-A-5-11416 has been proposed as improved acylacetanilide couplers. Although dyes formed from these couplers are improved in the hue, molecular extinction coefficient and preservability of image in comparison with conventional acylacetanilide couplers, they are still insufficient. Further, another problem in that a cost of the couplers increases due to complexity of their chemical structures is unavoidable.

On the other hand, benzisoxazolone compounds as described in British Patent 778,089 and indazolone compounds as described in British Patent 875,470 have been proposed as couplers forming azo dyes in place of the acylacetanilide couplers which form azomethine dyes. However, these couplers have not been employed in practice since yellow dyes formed from these couplers have an essential problem in that their absorption spectra shift to a longer wavelength side caused by an intramolecular hydrogen bond formed under a neutral condition.

SUMMARY OF THE INVENTION

Therefore, an object of the present invention is to provide a yellow coupler which provides a yellow dye having excellent hue, a large molecular extinction coefficient and storage stability.

Another object of the present invention is to provide a silver halide color photographic light-sensitive material which is excellent in color reproducibility, sharpness and color image fastness.

Other objects of the present invention will become apparent from the following description and examples.

As a result of designing a coupler having a novel skeleton according to calculation of molecular orbitals and verification its properties using a compound actually synthesized, the present inventors have found that a dye forming coupler represented by the formula (I) shown below has excellent properties and that the above-described objects can be accomplished with a silver halide color photographic light-sensitive material containing the dye forming coupler.

Specifically, the present invention relates to a silver halide color photographic light-sensitive material comprising a support having provided thereon at least one silver halide emulsion layer, wherein the silver halide color photographic light-sensitive material contains at least one dye forming coupler represented by the following formula (I):

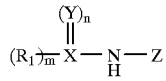

(I)

wherein $R_1$ represents a substituted or unsubstituted aliphatic group, a substituted or unsubstituted aromatic group, a substituted or unsubstituted heterocyclic group, a substituted or unsubstituted alkoxy group, a substituted or unsubstituted aryloxy group, a substituted or unsubstituted alkylthio group, a substituted or unsubstituted arylthio group or a substituted or unsubstituted amino group; X=Y represents C=O, C=$NR_2$, P=O or S=O; $R_2$ represents an aliphatic group or an aromatic group; Z represents a group capable of being released upon a reaction with the oxidation product of a developing agent; m and n each represents an integer of 1 or 2; $R_1$ and $R_2$, $R_1$ and Z or $R_2$ and Z may be combined with each other to form a ring; and when m is 2, two $R_1$'s may be the same or different, or may be combined with each other to form a ring.

BRIEF DESCRIPTION OF THE ACCOMPANYING DRAWING

FIG. 1 is a diagram showing absorption spectra of an azomethine dye (CD-1) and azo dyes (D-1) and (D-5) in ethyl acetate wherein the axis of ordinates denotes absorption density and the axis of abscissa denotes wavelength.

DETAILED DESCRIPTION OF THE INVENTION

Figure 1:
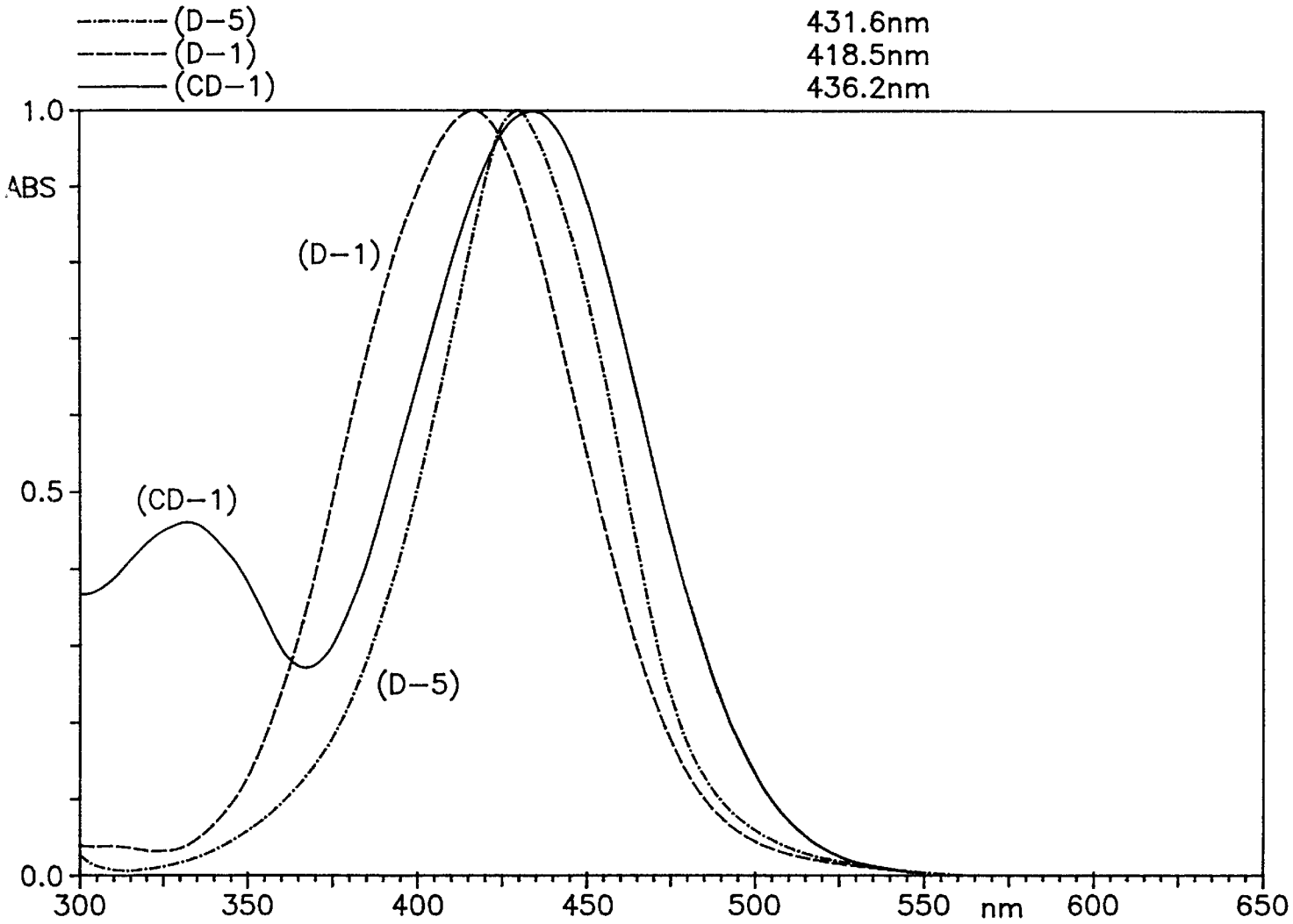

Now, the dye forming coupler according to the present invention will be descried in greater detail below.

In the formula (I) above, specific examples of the substituted or unsubstituted aliphatic group represented by $R_1$ include an octyl group, a 2-ethylhexyl group, a dodecyl group, a hexadecyl group, a tert-octyl group, an isodecyl group, an isostearyl group, a dodecyloxypropyl group and a 3-(2,4-di-tert-amylphenoxy)propyl group. Specific examples of the substituted or unsubstituted aromatic group represented by $R_1$ include a 4-dodecyloxyphenyl group, a 4-tetradecanoylaminophenyl group and a 2,4-di-tert-amylpheyl group. Specific examples of the substituted or unsubstituted heterocyclic group represented by $R_1$ include a 5-dodecyloxycarbonyl-2-furyl group and a 2-hexadecanoylamino-5-pyridyl group. Specific examples of the substituted or unsubstituted alkoxy group represented by $R_1$ include a hexadecyloxy group, a 2-hexyldecyloxy group, a dodecyloxypropyl group and a 3-(2,4-di-tert-amylphenoxy)propyloxy group. Specific examples of the substituted or unsubstituted aryloxy group represented by $R_1$ include a 4-tert-octylphenoxy group, a 2,4-di-tert-amylphenoxy group and a 3-pentadecylphenoxy group. Specific examples of the substituted or unsubstituted alkylthio group represented by $R_1$ include a hexadecylthio group and a 2-hexyldecylthio group. Specific examples of the substituted or unsubstituted arylthio group represented by $R_1$ include a 4-dodecylphenylthio group and a 2-tetradecanoylaminophenylthio group. Specific examples of the substituted or unsubstituted amino group represented by $R_1$ include a hexadecylamino group, a dodecyloxypropylamino group, a 3-(2,4-di-tert-amylphenoxy)-propylamino group, a 4-dodecyloxyanilino group, a 3-tetradecanoylaminoanilino group, a 2-methoxy-5-tetradecanoylaminoanilino group, an N-methyl-N-hexadecylamino group and an N-methyl-N-(4-dodecyloxyphenyl)amino group.

Of the groups represented by $R_1$, the substituted or unsubstituted alkoxy group, the substituted or unsubstituted aryloxy group and the substituted or unsubstituted amino group are preferred.

Of the groups represented by X=Y, C=O and C=$NR_2$ are preferred, and in case of C=$NR_2$, it is more preferred that $R_2$ is connected with $R_1$ to form a ring.

Specific examples of the group capable of being released upon a reaction with the oxidation product of a developing agent represented by Z include a halogen atom (e.g., fluorine, chlorine or bromine), an alkoxy group (e.g., ethoxy, methoxycarbonylmethoxy, carboxypropyloxy, methanesulfonylethoxy or perfluoropropoxy), an aryloxy group (e.g., 4-carboxyphenoxy, 4-(4-hydroxyphenylsulfonyl)phenoxy, 4-methanesulfonyl-3-carboxyphenoxy or 2-methanesulfonyl-4-acetylsulfamoylphenoxy), an acyloxy group (e.g., acetoxy or benzoyloxy), a sulfonyloxy group (e.g., methanesulfonyloxy or benzenesulfonyloxy) an acylamino group (e.g., heptafluorobutyrylamino), a sulfonamido group (e.g., methanesulfonamido), an alkoxycarbonyloxy group (e.g., ethoxycarbonyloxy), a carbamoyloxy group (e.g., diethylcarbamoyloxy, piperidinocarbonyloxy or morpholinocarbonyloxy), an alkylthio group (e.g., 2-carboxyethylthio), an arylthio group (e.g., 2-octyloxy-5-tert-octylphenylthio or 2-(2,4-di-tert-amylphenoxy) butyrylaminophenylthio), a heterocyclic thio group (e.g., 1-phenyltetrazolylthio or 2-benzimidazolylthio), a heterocyclic oxy group (2-pyridyloxy or 5-nitro-2-pyridyloxy), a 5-membered or 6-membered nitrogen-containing heterocyclic group (e.g., 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl or 5,5-dimethyloxazolidine-2,4-dion-3-yl), and an azo group (e.g., 4-methoxyphenylazo or 4-pivaloylaminophenylazo).

Z may also be a release group having a timing function which further releases a development inhibitor or a development accelerator by electron transfer or intramolecular nucleophilic substitution after being released.

Preferred examples of the group represented by Z include a chlorine atom, an aryloxy group, a heterocyclic oxy group, a carbamoyloxy group and a 5-membered nitrogen-containing heterocyclic group. More preferred examples of the group represented by Z include an aromatic oxy group, a heterocyclic oxy group and a nitrogen-containing heterocyclic group. More preferably, these groups have a dissociation group having a low pKa value, for example, a carboxy group or an acylsulfamoyl group. When Z is connected with $R_1$ to form a ring, a release atom in the group of Z is preferably an oxygen atom.

It is desired that the coupler according to the present invention have a ballast group having at least 8 carbon atoms, preferably at least 12 carbon atoms in any of $R_1$ and $R_2$. Alternatively, the total number of carbon atoms included in $R_1$ and $R_2$ is preferably at least 12. Further, the coupler having the ballast group in Z instead of $R_1$ and $R_2$ is useful as a non-color forming coupler of dye-release type.

The coupler represented by the formula (I) according to the present invention may form a dimer or more polymer through the substituent of $R_1$, $R_2$ or Z, or may be bonded to a polymer chain.

Specific examples of the coupler according to the present invention are set force below, but the present invention should not be construed as being limited thereto.

(1)

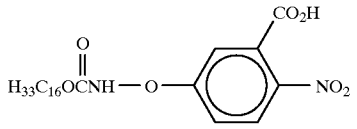

(2)

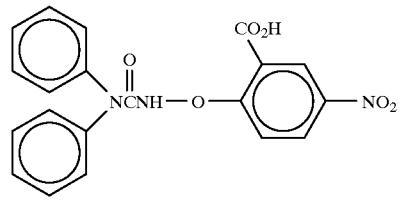

(3)

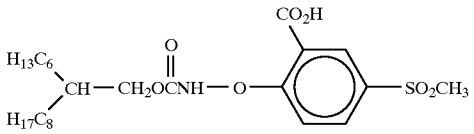

-continued
(4)
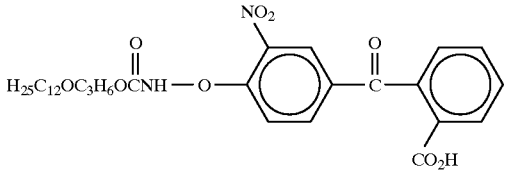
(5)
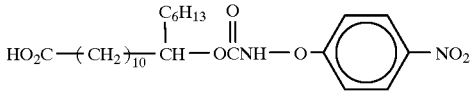
(6)
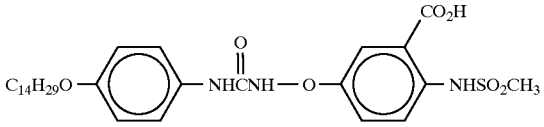
(7)
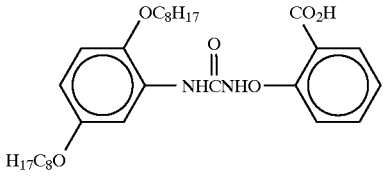
(8)
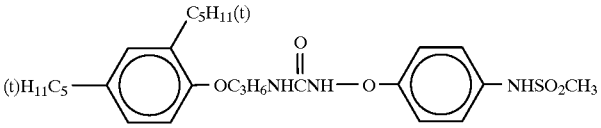
(9)
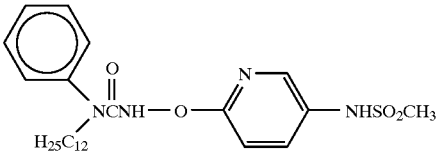
(10)
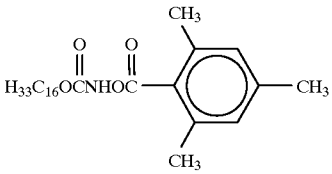
(11)
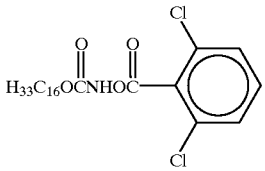
(12)
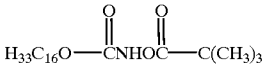

-continued
(12)
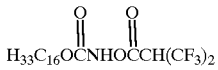
(14)
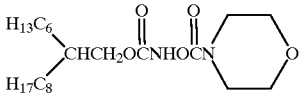
(15)
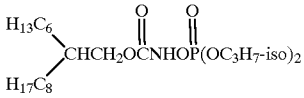
(16)
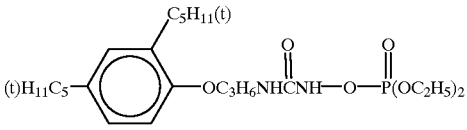
(17)
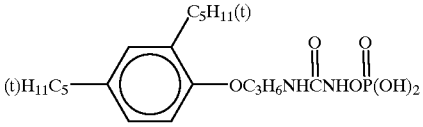
(18)
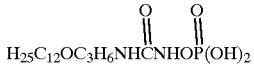
(19)
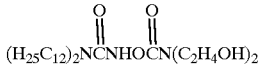
(20)
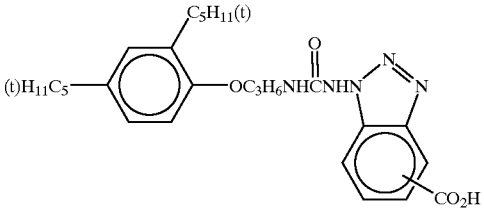
(21)
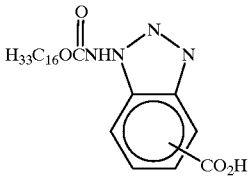
(22)
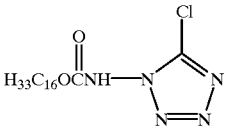

-continued
(23)
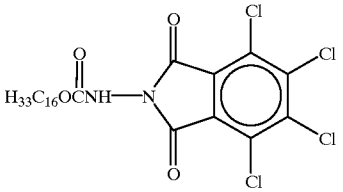
(24)
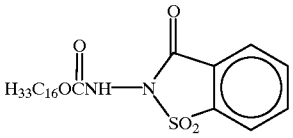
(25)
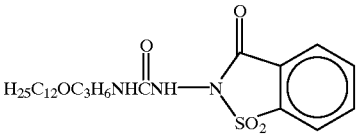
(26)
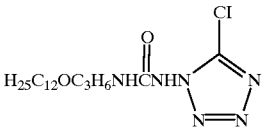
(27)
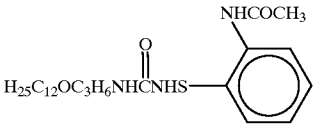
(28)
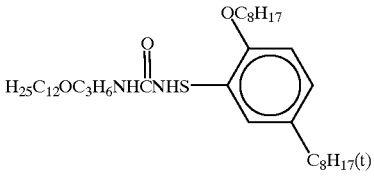
(29)
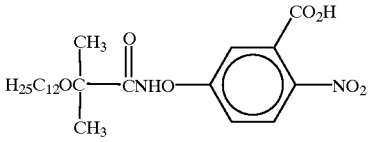
(30)
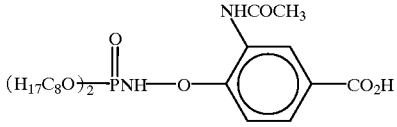
(31)
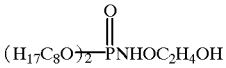
(32)
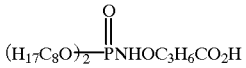

-continued
(33)
$H_{33}C_{16}SO_2NHOC_3H_6CO_2H$
(34)
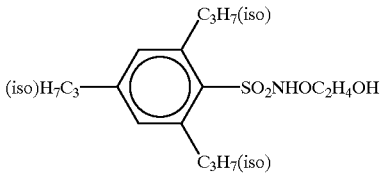
(35)
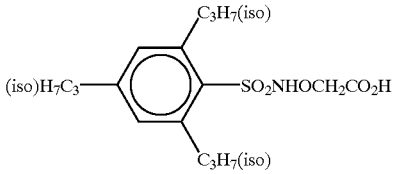
(36)
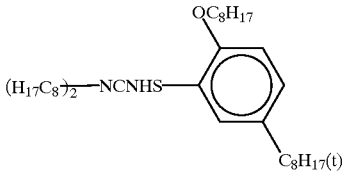
(37)
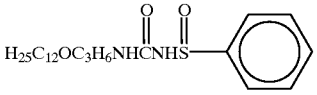
(38)
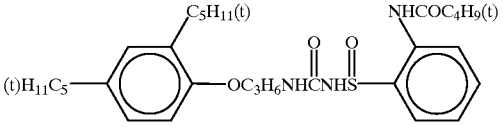
(39)
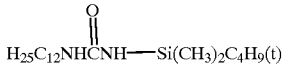
(40)
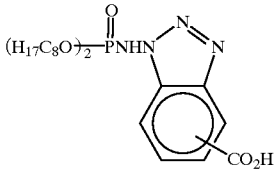
(41)
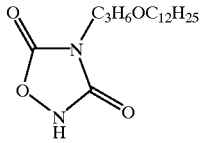
(42)
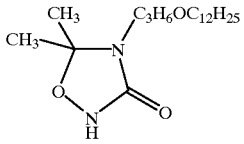

-continued
(43)
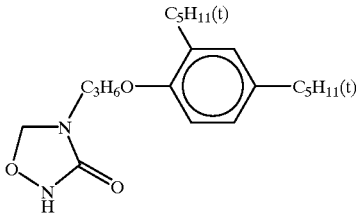
(44)
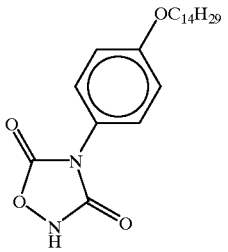
(45)
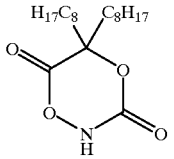
(46)
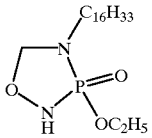
(47)
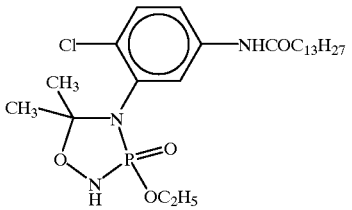
(48)
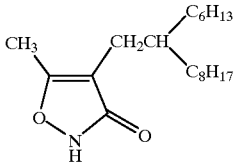
(49)
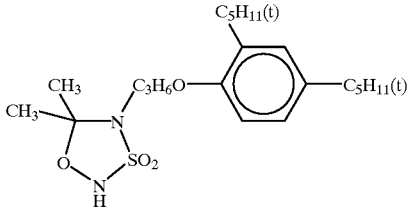

-continued
(50)
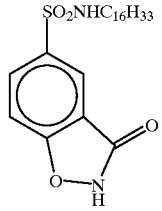
(51)
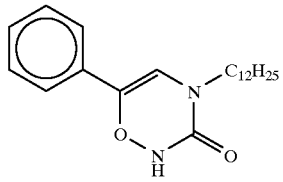
(52)
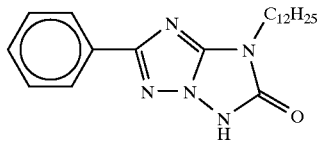
(53)
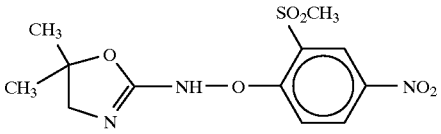
(54)
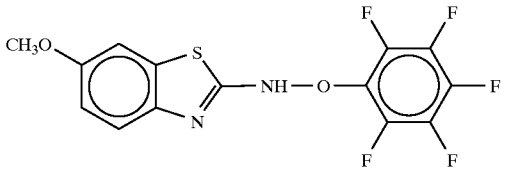
(55)
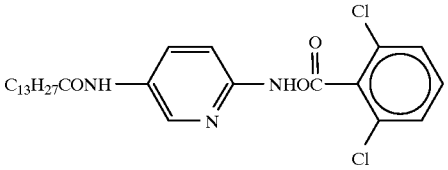
(56)
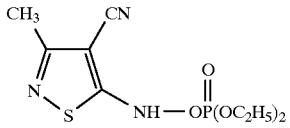
(57)
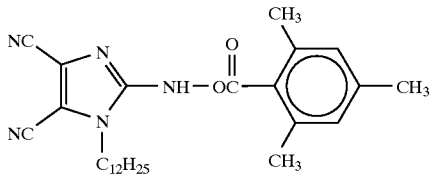
Most of the couplers according to the present invention are novel compounds, but these can be synthesized in a relatively easy manner. Specifically, the coupler is synthesized along the route shown below.

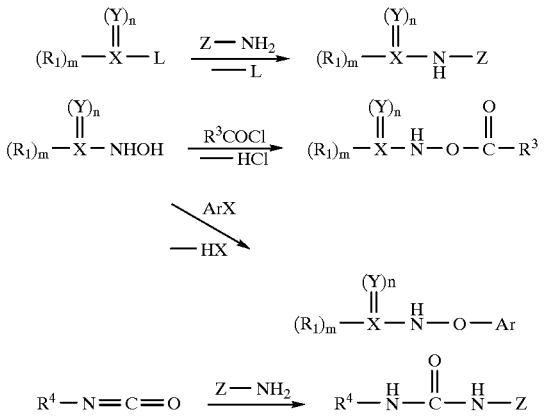

wherein $R_1$, X, Y, Z, m and n each has the same meaning as defined in the formula (I) above, L represents a halogen atom or an aryloxy group, $R^3$ has the same meaning as $R_1$, Ar represents an aromatic hydrocarbon group or an aromatic heterocyclic group, and $R^4$ represents an aliphatic group or an aromatic group.

For instance, when $R_1$ is an alkoxy group, the coupler is synthesized by a reaction of a chlorocarbonate with an amino derivative (Z—$NH_2$) for the release group, or a reaction of an N-hydroxyurethane with an acid halide or halogenated aryl compound.

When $R_1$ is a substituted amino group, on the other hand, the coupler is synthesized by a reaction of an isocyanate, N-substituted phenylurethane or carbamoyl chloride with the amino derivative (Z—$NH_2$), or a reaction of an N-hydroxyureido with an acid halide or halogenated aryl compound.

Further, when Z and $R_1$ are connected with each other to form a ring, the coupler is synthesized according to the method as described in *Arch. Pharm. Ber. Dtsch. Pharm. Ges.*, Vol. 314, Page 294 (1981).

Synthesis examples of the coupler are specifically described below.

SYNTHESIS EXAMPLE 1

SYNTHESIS OF COUPLER (1)

In 100 ml of water was dissolved 69.5 g of hydroxylamine hydrochloride and to the solution was added 500 ml of tetrahydrofuran. Under cooling with ice, 153 g of hexadecyl chlorocarbonate was dropwise added thereto. After the completion of the addition, the reaction mixture was stirred for 30 minutes at room temperature. Then, the tetrahydrofuran was distilled off under a reduced pressure and to the residue was added one liter of cool water. The white crystals thus formed were collected by filtration, thoroughly washed with water and methanol and dried. Yield was 144 g.

A mixture of 15.1 g of the white crystals described above, 10.2 g of 5-fluoro-2-nitrobenzoic acid, 17.2 g of anhydrous potassium carbonate and 120 ml of dimethylacetamide was heated at 70° C. for 2 hours with stirring. After allowing to stand for cooling, the reaction mixture was poured into cool diluted hydrochloric acid and extracted with ethyl acetate. The organic layer was washed with water and dried, and the ethyl acetate was distilled off under a reduced pressure. The residue was purified by silica gel column chromatography using a mixture of n-hexane and ethyl acetate (1:1 in volume) as an eluate to obtain 20.1 g of Coupler (1) as white crystals.

SYNTHESIS EXAMPLE 2

SYNTHESIS OF COUPLER (2)

In a mixture of 50 ml of water and 100 ml of methanol was dissolved 41.7 g of hydroxylamine hydrochloride and to the solution was added 200 ml of tetrahydrofuran. Under cooling with ice, 69.5 g of diphenylcarbamoyl chloride was dropwise added thereto. After the completion of the addition, the reaction mixture was stirred for ohe hour at room temperature, and then, 200 ml of water was added thereto. The white crystals thus formed were collected by filtration, washed with diluted methanol and dried. Yield was 52 g.

A mixture of 11.4 g of the white crystals described above, 10.2 g of 2-fluoro-5-nitrobenzoic acid, 17.2 g of anhydrous potassium carbonate and 100 ml of dimethylacetamide was heated at temperature of 70 to 75° C. for 2 hours with stirring. After allowing to stand for cooling, the reaction mixture was poured into cool diluted hydrochloric acid. The precipitate thus formed was collected by filtration, washed with water and dried. The crude product was recrystallized from methanol to obtain 14.3 g of Coupler (2) as white crystals.

SYNTHESIS EXAMPLE 3

SYNTHESIS OF COUPLER (11)

In a mixture of 100 ml of ethyl acetate, 100 ml of water and 10 ml of acetonitrile was dissolved 9.1 g of the white crystals obtained by the reaction of hydroxylamine hydrochloride with hexadecyl chlorocarbonate in Synthesis Example 1, and the solution was vigorously stirred. To the solution was added 10.1 g of sodium hydrogen carbonate and then, 12.6 g of 2,6-dichlorobenzoic chloride was fractionally added thereto over a period of 20 minutes. After the completion of the addition, the reaction mixture was stirred for one hour, 2 ml of a 25% aqueous ammonia was dropwise added thereto, and the reaction mixture was further stirred for 10 minutes. Concentrated hydrochloric acid was added to the reaction mixture until the reaction mixture indicated acid. Then, the mixture was subjected to separating operation to obtain the organic layer, and the ethyl acetate was distilled off under a reduced pressure. The residue was purified by silica gel column chromatography using a mixture of n-hexane and ethyl acetate (8:1 in volume) as an eluate to obtain 11.2 g of Coupler (11) as white crystals.

It is sufficient for the photographic light-sensitive material of the present invention to comprise a support having thereon at least one layer containing the coupler according to the present invention, and the coupler is, in general, contained in a hydrophilic colloid layer comprising a gelatin binder. Ordinary photographic light-sensitive materials can comprise at least one blue-sensitive sliver halide emulsion layer, at least one green-sensitive silver halide emulsion layer and at least one red-sensitive sliver halide emulsion layer on a support, and the order of the arrangement of the layers are not particularly limited. Further, an infrared-sensitive silver halide emulsion layer can be provided in place of one of the above-described light-sensitive emulsion layers. Color reproduction can be effected according to the subtractive color process by incorporating into these light-sensitive emulsion layers couplers capable of forming dyes having a complementary color relationship to light to which the corresponding silver halide emulsion is sensitive. Further, a constitution of a different correspondence of the spectral absorption wavelength region of a spectral sensitizing dye incorporated into a light-sensitive layer to a hue of dye formed from the coupler from that described above may be employed.

The couplers according to the present invention are mainly usable as yellow couplers or magenta couplers in conventional color photographic light-sensitive materials using a p-phenylenediamine as a color developing agent, and can be incorporated into any light-sensitive silver halide emulsion layer. Further, the couplers according to the present invention are useful as dye forming couplers which provide dyes having various hue in a system wherein a color developing agent other than p-phenylenediamine is employed.

The amount of the coupler according to the present invention added to a photographic light-sensitive material is suitably from $1\times10^{-3}$ to 1 mol, preferably from $2\times10^{-3}$ to $3\times10^{-1}$ mol, per mol of the silver halide.

The coupler according to the present invention can be incorporated into a photographic light-sensitive material using various known dispersion methods, and an oil droplet-in-water dispersion method is preferably used, which comprises dissolving the coupler in a high boiling point organic solvent (a low boiling point organic solvent may be used in combination, if desired), dispersing the solution of coupler into an aqueous gelatin solution in the form of an emulsion, and incorporating the dispersion into a silver halide emulsion.

Suitable examples of the high boiling point organic solvents which can be used in the oil droplet-in-water dispersion method are described, for example, in U.S. Pat. No. 2,322,027. Further, specific examples of a latex dispersion method, which is one of polymer dispersion methods, are described, for example, in U.S. Pat. No. 4,199,363, West German Patent Application (OLS) No. 2,541,274, JP-B-53-41091 (the term "JP-B" as used herein means an "examined Japanese patent publication"), EP-A-727703 and EP-A-727704, and a dispersion method using an organic solvent-soluble polymer is described in WO 88/723.

Specific examples of high boiling point organic solvents which can be used in the oil droplet-in-water dispersion method include phthalic acid esters (e.g., dibutyl phthalate, dioctyl phthalate or di-2-ethylhexyl phthalate), phosphoric acid or phosphonic acid esters (e.g., triphenyl phosphate, tricresyl phosphate or tri-2-ethylhexyl phosphate), fatty acid esters (e.g., di-2-ethylhexyl succinate or tributyl citrate), benzoic acid esters (e.g., 2-ethylhexyl benzoate or dodecyl benzoate), amides (e.g., N,N-diethyldodecanamide or N,N-dimethyloleinamide), alcohols or phenols (e.g., isostearyl alcohol or 2,4-di-tert-amylphenol), anilines (e.g., N,N-dibutyl-2-butoxy-5-tert-octylaniline), chlorinated paraffins, hydrocarbons (e.g., dodecylbenzene or diisopropylnaphthalene), and carboxylic acids (e.g., 2-(2,4-di-tert-amylphenoxy)-butyrate). Further, an organic solvent having a boiling point of from 30° C. to 160° C. (e.g., ethyl acetate, butyl acetate, methyl ethyl ketone, cyclohexanone, methyl Cellosolve acetate or dimethylformamide) may be used in combination as an auxiliary solvent. The high boiling point organic solvent can be used in a range of from 0 to 10 times, preferably from 0 to 4 times, of the amount of the coupler, in a weight ratio.

In the silver halide color photographic light-sensitive material according to the present invention, other various conventionally known photographic elements and additives can be employed.

For instance, a transmissive type support or reflective type support is used as the photographic support. Among the transmissive type support, a transparent film such as a cellulose triacetate film or a polyethylene terephthalate film, and a polyester film composed of 2,6-naphthalenedicarboxylic acid (NDCA) and ethylene glycol (EG) or composed of NDCA, terephthalic acid and EG having provided thereon an information recording layer such as a magnetic layer are preferably employed. Of the reflective type supports, a laminate composed of plural water-resistant resin layers such as polyethylene layers or polyester layers and containing a white pigment such as titanium oxide in at least one of the resin layers is preferred.

It is preferred that the water-resistant resin layer contains a fluorescent whitening agent. The fluorescent whitening agent may also be dispersed in a hydrophilic colloid layer of the photographic light-sensitive material. Preferred fluorescent whitening agents used include benzoxazole series, cumarin series and pyrazoline series compounds. Fluorescent whitening agents of benzoxazolyl naphthalene series and benzoxazolyl stilbene series are more preferably used. The amount of the fluorescent whitening agent to be used is not particularly limited and preferably in a range of from 1 to 100 mg/m$^2$. A mixing ratio of the fluorescent whitening agent to be used in the water-resistant resin layer is preferably from 0.0005 to 3% by weight, and more preferably from 0.001 to 0.5% by weight of the resin.

Further, a transmissive type support and a reflective type support each having provided thereon a hydrophilic colloid layer containing a white pigment may be employed as the reflective type support.

Moreover, a support having a mirror plate reflective metal surface or a secondary diffusion reflective metal surface may be used as the reflective type support.

A silver chloride, silver bromide, silver iodobromide or silver chloro(iodo)bromide emulsion is used as the silver halide emulsion in the color photographic light-sensitive material of the present invention. A silver chloride or silver chlorobromide emulsion having a silver chloride content of 95 mol % or more is preferably employed in view of rapid processing suitability. Further, a silver halide emulsion having a silver chloride content of 98 mol % or more is more preferred. Of these silver halide emulsions, those having a silver bromide localized phase on the surface of silver chloride grain is particularly preferred, since high sensitivity as well as stabilization of photographic characteristics are achieved.

With respect to the reflective type support, silver halide emulsion, heterogenous metal ion doped in silver halide grain, stabilizer and antifoggant for silver halide emulsion, chemical sensitization (chemical sensitizer), spectral sensitization (spectral sensitizer), cyan coupler, magenta coupler, yellow coupler, emulsified dispersion method of coupler, color image stabilizer (anti-staining agent), color fading preventing agent, dye (colored layer), gelation, layer construction of photographic material and pH of coated layer, those described in the patents shown in Table 1 are preferably used in the present invention.

TABLE 1

| Photographic Element | JP-A-7-104448 | JP-A-7-77775 | JP-A-7-301895 |
|---|---|---|---|
| Reflective Type Support | Col. 7, line 12 to Col. 12, line 19 | Col. 35, line 43 to Col. 44, line 1 | Col. 5, line 40 to Col. 9, line 26 |
| Silver Halide | Col. 72, line 29 | Col. 44, line | Col. 77, line 48 |

TABLE 1-continued

| Photographic Element | JP-A-7-104448 | JP-A-7-77775 | JP-A-7-301895 |
|---|---|---|---|
| Emulsion | 50 Col. 74, line 18 | 36 to Col. 46, line 29 | to Col. 80, line 28 |
| Heterogeneous Metal Ion | Col. 74, lines 19 to 44 | Col. 46, line 30 to Col. 47, line 5 | Col. 80, line 29 to Col. 81, line 6 |
| Stabilizer and Antifoggant | Col. 75, lines 9 to 18 | Col. 47, lines 20 to 29 | Col. 18, line 11 to Col. 31, line 37 (particu-larly, mercapto hetero-cyclic compound) |
| Chemical Sensitization (Chemical Sensitizer) | Col. 74, line 45 to Col. 75, line 6 | Col. 47, lines 7 to 17 | Col. 81, lines 9 to 17 |
| Spectral Sensitization (Spectral Sensitizer) | Col. 75, line 19 to Col. 76, line 45 | Col. 47, line 30 to Col. 49, line 6 | Col. 81, line 21 to Col. 82, line 48 |
| Cyan Coupler | Col. 12, line 20 to Col. 39, line 49 | Col. 62, line 50 to Col. 63, line 16 | Col. 88, line 49 to Col. 89, line 16 |
| Yellow Coupler | Col. 87, line 40 to Col. 88, line 3 | Col. 63, lines 17 to 30 | Col. 89, lines 17 to 30 |
| Magenta Coupler | Col. 88, line 4 to Col. 89, line 18 | Col. 63, line 31 to Col. 64, line 11 | Col. 32, line 34 to Col. 77, line 44 and Col. 88, lines 32 to 46 |
| Emulsified Dispersion Method of Coupler | Col. 71, line 3 to Col. 72, line 11 | Col. 61, lines 36 to 49 | Col. 87, lines 35 to 48 |
| Color Image Stabilizer (Anti-staining Agent) | Col. 39, line 50 to Col. 70, line 9 | Col. 61, line 50 to Col. 62, line 49 | Col. 87, line 49 to Col. 88, line 48 |
| Color Fading Preventing Agent | Col. 70, line 10 to Col. 71, line 2 | | |
| Dye (Colored Layer) | Col. 77, line 42 to Col. 78, line 41 | Col. 7, line 14 to Col. 19, line 42 and Col. 50, line 3 line 14 | Col. 9, line 27 to Col. 18, line 10 |
| Gelatin | Col. 78, lines 42 to 48 | Col. 51, lines 15 to 20 | Col. 83, lines 13 to 19 |
| Layer Construction of Photographic Material | Col. 39, lines 11 to 26 | Col. 44, lines 2 to 35 | Col. 31, line 38 to Col. 32, line 33 |
| pH of Coated Layer of Photographic Material | Col. 72, lines 12 to 28 | | |
| Scanning Exposure | Col. 76, line 6 to Col. 77, line 41 | Col. 49, line 7 to Col. 50, line 2 | Col. 82, line 49 to Col. 83, line 12 |
| Preservative in Developing Solution | Col. 88, line 19 to Col. 89, line 22 | | |

The cyan couplers, magenta couplers and yellow couplers which can be suitably employed in the present invention also include those described in JP-A-62-215272, page 91 right upper column, line 4 to page 121, left upper column, line 6, JP-A-2-33144, page 3, right upper column, line 14 to page 18, left upper column, last line and page 30, right upper column, line 6 to page 35, right lower column, line 11, and EP-A-355660, page 4, lines 15 to 27, page 5, line 30 to page 28, last line, page 45, lines 29 to 31 and page 47, line 23 to page 63, line 50.

The bactericides and anti-mold agents described in JP-A-63-271247 are suitably used in the present invention.

Gelatin is preferably employed as a hydrophilic colloid in a photographic layer constituting the photographic light-sensitive material according to the present invention. An amount of heavy metal, for example, iron, copper, zinc or manganese, which is included as an impurity in gelatin is preferably not more than 5 ppm, more preferably not more than 3 ppm.

The silver halide photographic light-sensitive material according to the present invention is suitable for a scanning exposure system using a cathode ray tube (CRT) in addition to a conventional printing system using a negative printer.

An exposure device using a cathode ray tube is simple, compact and low-cost in comparison with an exposure device using a laser beam. Also, the former is advantageous in view of easy control of an optical axis and color.

In the cathode ray tube used for the image exposure, various light emitting materials which emit light in the visible spectra are employed depending on the demand. For instance, a red light emitting material, a green light emitting material and a blue light emitting material are used individually or in a combination of two or more thereof. The light emitting materials are not limited to those of red, green and blue described above, and other light emitting materials which emit yellow light, orange light, purple light or infrared light may also be utilized. Particularly, a cathode ray tube using a combination of these light emitting materials to emit white light is frequently employed.

When the photographic light-sensitive material having a plural of light-sensitive layers each having a different spectral sensitivity and the cathode ray tube having a plural of light emitting materials each emitting light having a different spectrum are used, a plural of color image signals are input to the cathode ray tube to emit the respective light and the photographic light-sensitive material may be exposed to a plural of colors at once. Alternatively, a successive exposure method wherein each color light is emitted according to the input of the corresponding image signal, in order, and filters which cut color light other than the desired color light are used can be adopted. In general, the successive exposure method is preferred to obtain high quality images, since a cathode ray tube of high resolving power can be used.

The photographic light-sensitive material of the present invention can preferably be used in digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the spectral sensitivity maximum of the photographic light-sensitive material of the present invention can be appropriately set according to the wavelength of the scanning exposure light source to be used. As an oscillation wavelength of a laser can be made half using an SHG light source comprising a combination of non-linear optical crystal with a solid state laser using a semiconductor laser as an excitation light source or a semiconductor laser, blue light and green light can be obtained. Accordingly, it is possible to have the spectral sensitivity maximum of the photographic light-sensitive material in normal three regions of blue, green and red.

The exposure time in the scanning exposure is defined as the time necessary to expose the pixel size with the pixel density being 400 dpi, and preferred exposure time is $10^{-4}$ second or less and more preferably $10^{-}$ second or less.

Preferred scanning exposure systems suitable for use in the present invention are described in detail in the patents set forth in the table shown above.

In order to process the silver halide photographic light-sensitive material of the present invention, processing elements and processing methods described in JP-A-2-207250, page 26, right lower column, line 1 to page 34, right upper column, line 9 and JP-A-4-97355, page 5, left upper column, line 17 to page 18, right lower column, line 20 are preferably employed. As preservatives in developing solution, the compounds described in the patent set forth in the table shown above are preferably employed.

In order to conduct development processing of the photographic light-sensitive material according to the present invention after imagewise exposure, a wet type developing process, for example, a developing method using a conventional developing solution containing an alkaline agent and a developing agent, and an activator method in which a photographic light-sensitive material containing a developing agent is developed with an activator solution such as an alkaline solution containing no developing agent, as well as a dry type developing process without using a processing solution, for example, a heat developing method can be employed. Particularly, the activator method is preferred since the processing solution does not contain a developing agent, thus the control and handling of the processing solution are easy. Also, it is favorable in view of the environmental conservation since a load for treatment of the waste solution is small.

The developing agents and precursors thereof which can be incorporated into the photographic light-sensitive material used in the activator method are preferably hydrazine series compounds described, for example, in Japanese Patent Application No. 8-287288, JP-A-8-234388, JP-A-9-152686, JP-A-9-152693 and JP-A-9-160193.

Further, a developing method wherein the photographic light-sensitive material having a reduced coating amount of silver is subjected to an image amplification process (intensification process) using hydrogen peroxide is preferably employed. In particular, it is preferred to apply this method to the activator method. Specifically, an image forming method using the activator solution containing hydrogen peroxide as described in JP-A-8-297354 and JP-A-9-152695 is preferably employed.

According to the activator method, the photographic material is ordinarily subjected to a desilvering treatment after the treatment with the activator solution. However, in the image amplification process using the photographic material having a reduced coating amount of silver, the desilvering treatment is omitted and a simple treatment such as washing with water or stabilizing treatment is conducted. Further, in a system wherein an image information is read from a photographic material by a scanner, the processing method omitting the desilvering treatment can be adopted, even when a photographic light-sensitive material having a large coating amount of silver such as a photographic light-sensitive material for photographing is processed.

Processing elements and processing methods for the activator treatment, desilvering (bleaching/fixing), water washing and stabilizing used in the present invention include those known in the art. Preferably, those described in *Research Disclosure*, September 1994, Item 36544, pages 536 to 541 and JP-A-8-234388 are employed.

The coupler according to the present invention can be also preferably employed in a photographic light-sensitive material having a magnetic recording layer suitable for use in an advanced photo system. Further, the coupler according to the present invention can be applied to a system in which heat development is conducted using a small amount of water and a completely dry system in which heat development is performed without using any water. These systems are described in greater detail, for example, in JP-A-6-35118, JP-A-6-17528, JP-A-56-146133, JP-A-60-119557 and JP-A-1-161236.

The color photographic light-sensitive material of the present invention includes not only a photographic light-sensitive material forming a color image but also a photographic light-sensitive material forming a monotone image including a black and white image.

The dye forming coupler according to the present invention provides a dye having an excellent spectral absorption characteristic, a large molecular extinction coefficient. The color image obtained from the coupler according to the present invention is excellent in heat fastness.

The silver halide color photographic light-sensitive material according to the present invention is excellent in color reproducibility, sharpness and color image fastness.

The present invention will be explained in greater detail with reference to the following examples, but the present invention should not be construed as being limited thereto.

EXAMPLE 1

To a mixture of 0.85 g of comparative coupler (C-1) shown below, 0.80 g of N-ethyl-N-(β-methanesulfonamidoethyl)-3-methyl-4-aminoaniline sulfate, 3.75 g of sodium carbonate, 60 ml of chloroform and 50 ml of water was gradually added a solution containing 1.45 g of ammonium persulfate dissolved in 10 ml of water at room temperature with stirring. After stirring for one hour, the chloroform layer was separated and purified by silica gel column chromatography to obtain comparative yellow azomethine dye (CD-1) shown below. Further, azo dyes (D-1) to (D-4) shown below were prepared in the same manner as above using Couplers (1), (2), (30) and (35) according to the present invention, respectively, in place of the comparative coupler (C-1).

Comparative Coupler (C-1)

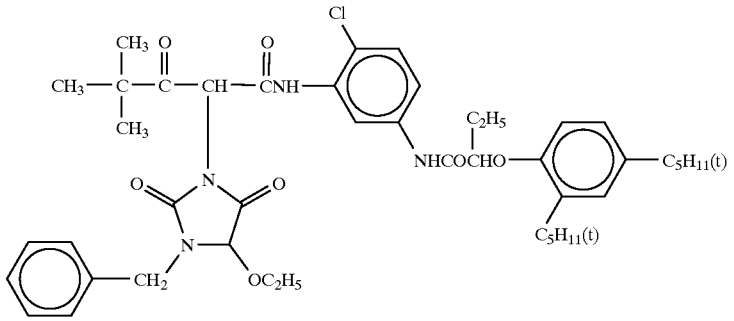

Comparative Dye (CD-1)

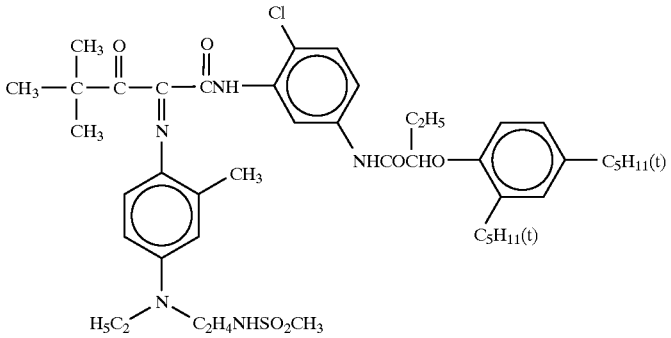

(D-1)

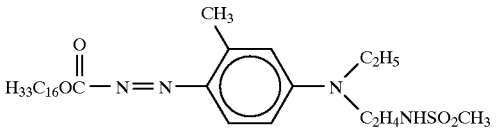

(D-2)

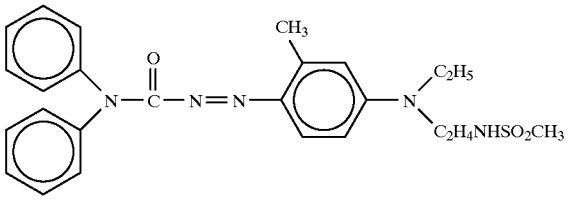

(D-3)

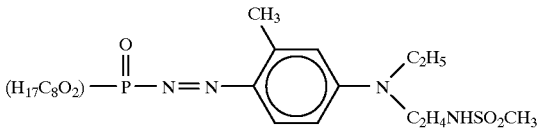

(D-4)

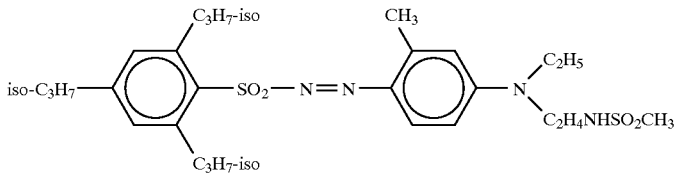

In the reaction of Coupler (1) according to the present invention, in addition to azo dye (D-1), azo dye (D-5) shown below was obtained as a result of the reaction between two molecules of the coupler and one molecule of the developing agent. The azo dye (D-5) is believed to be prepared according to the reaction shown below, while it is not clear in detail. Specifically, Coupler (1) according to the present invention nucleophilically attacks a carbon atom in the oxidation product of developing agent (1,4-addition reaction) and releases a release group to create a novel oxidation product. This oxidation product causes a coupling reaction with another molecule of Coupler (1) to form the azo dye (D-5).

(D-5)

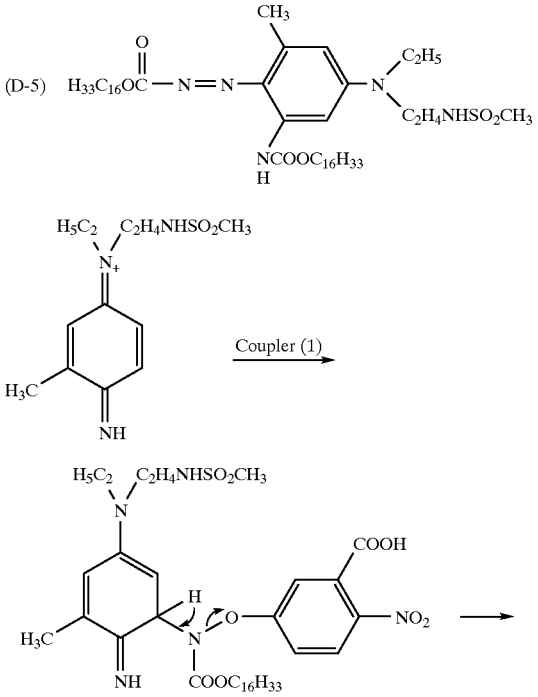

-continued

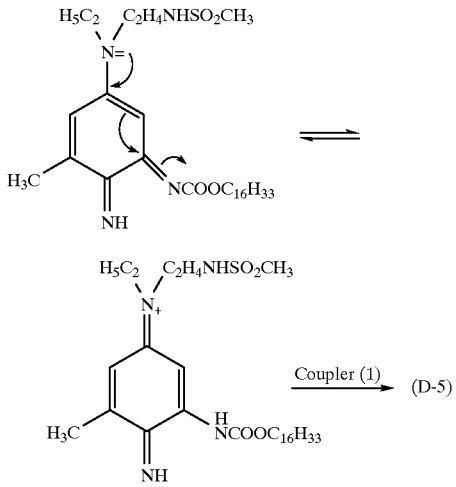

Also, in the reactions of Couplers (2), (30) and (35) according to the present invention, azo dyes (D-6) to (D-8) shown below were obtained, in addition to azo dyes (D-2) to (D-4), respectively.

(D-6)

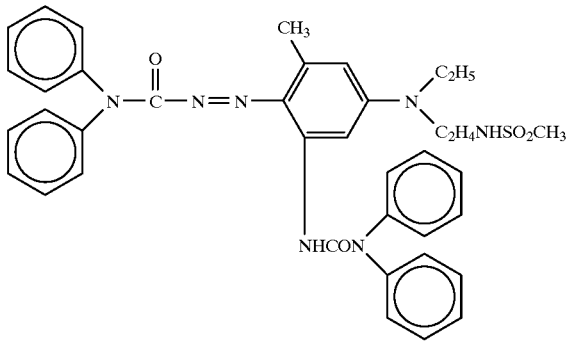

(D-7)

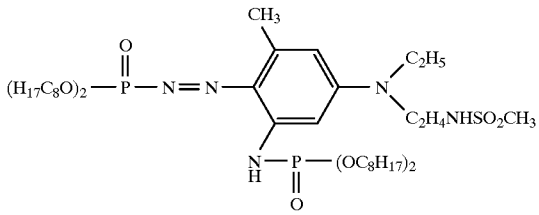

-continued (D-8)

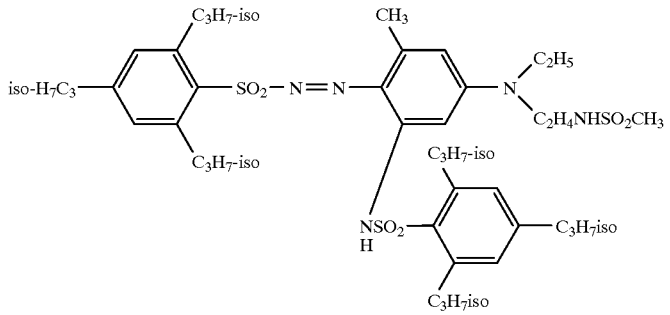

1.5 mg of comparative azomethine dye (CD-1) was precisely measured and put into a 100 ml measuring flask. Ethyl acetate was added to the flask to dissolve the dye to form 100 ml of Sample Solution 101.

Sample Solution 101 was put into a quartz cell having a thickness of 1 cm, a visible absorption spectrum therefore was measured using an ultraviolet visible spectroter photometer manufactured by Shimadzu Corp., and a molecular extinction coefficient of the dye was determined.

Ethyl acetate solutions (Sample Solutions 102 to 106) of azo dyes (D-1) to (D-5) were prepared and their absorption spectra and molecular extinction coefficients were measured in the same manner as above.

The absorption spectra of comparative dye (CD-1) and dyes (D-1) and (D-5) according to the present invention in ethyl acetate are shown in FIG. 1. Also, the molecular extinction coefficients of dyes (CD-1) and (D-1) to (D-5) are shown Table 2 below.

TABLE 2

| Sample Solution | Dye | Molecular Extinction Coefficient | Remarks |
|---|---|---|---|
| 101 | (CD-1) | 16500 | Comparative Example |
| 102 | (D-1) | 26900 | Present Invention |
| 103 | (D-2) | 26900 | Present Invention |
| 104 | (D-3) | 39700 | Present Invention |
| 105 | (D-4) | 34500 | Present Invention |
| 106 | (D-5) | 42200 | Present Invention |

From the results shown in FIG. 1, it can be seen that the dye formed from the coupler according to the present invention exhibits a sharp absorption spectrum which is sharpcut in the long wavelength side. Further, the dye formed from the coupler according to the present invention has a large molecular extinction coefficient as is apparent from the results shown in Table 2.

EXAMPLE 2

Preparation of Sample 201

An emulsified dispersion of comparative coupler (C-1) was prepared in the manner shown below.

0.88 g of comparative coupler (C-1) and 2.6 g of tricresyl phosphate were solved in 10 ml of ethyl acetate by heating to prepare an oil phase solution.

Separately, 4.2 g of gelatin was added to 25 ml of water of room temperature, after the gelatin was sufficiently swollen, the mixture was heated at 40° C. to thoroughly dissolve. To the aqueous gelatin solution, while maintaining at about 40° C., were added 3 ml of a 5% aqueous solution of sodium dodecylbenzenesulfonate and the oil phase solution described above, and the mixture was emulsified and dispersed by a homogenizer to prepare the emulsified dispersion.

A coating solution having the composition shown below was prepared using the emulsified dispersion, and coated on a polyethylene laminated paper having an undercoat layer in an amount of coupler of 1 mmol/$m^2$. Then, gelatin was coated thereon in an amount of 2 g/$m^2$ as a protective layer to prepare Sample 201.

| Coating Solution | |
|---|---|
| Silver chlorobromide emulsion (Br: 30 mol %) | 13 g |
| 10% Aqueous gelatin solution | 28 g |
| Emulsified dispersion described above | 22 g |
| Water | 37 ml |
| 4% Aqueous solution of 1-hydroxy-3,5-dichloro-s-trizine sodium salt | 5 ml |

Preparation of Samples 202 to 208

Samples 202 to 208 were prepared in the same manner as the preparation of Sample 201, except for using an equimolar amount of each of the coupler according to the present invention shown in Table 3 below in place of the comparative coupler (C-1).

Each of the samples thus-prepared was wedgewise exposed to white light and subjected to color development processing according to the processing steps shown below.

| Processing Step | Processing Temperature | Processing Time |
|---|---|---|
| Color Development | 35° C. | 3 minutes |
| Bleach-Fixing | 30 to 36° C. | 45 seconds |
| Stabilizing (1) | 30 to 37° C. | 20 seconds |
| Stabilizing (2) | 30 to 37° C. | 20 seconds |
| Stabilizing (3) | 30 to 37° C. | 20 seconds |
| Drying | 70 to 85° C. | 60 seconds |

The composition of each processing solution was as follows.

| Color Developing Solution | |
|---|---|
| Water | 800 ml |
| Ethylenediaminetetraacetic Acid | 2.0 g |
| Triethanolamine | 8.0 g |
| Sodium Chloride | 1.4 g |
| Potassium Bromide | 0.6 g |
| Potassium Carbonate | 25 g |

-continued

| | |
|---|---|
| N-Ethyl-N-(β-methanesulfonamido-ethyl)-3-methyl-4-aminoaniline Sulfate | 5.0 g |
| N,N-Diethylhydroxylamine | 4.2 g |
| 5,6-Dihydroxybenzene-1,2,4-trisulfonic Acid | 0.3 g |
| Fluorescent Brightening Agent (WHITEX 4, manufactured by Sumitomo Chemical Co., Ltd.) | 2.0 g |
| Water to make | 1,000 ml |
| pH (25° C.) | 10.25 |
| **Breach-Fixing Solution** | |
| Water | 400 ml |
| Ammonium Thiosulfate Aqueous Solution (700 g/liter) | 100 ml |
| Sodium Sulfite | 18 g |
| Ammonium Ethylenediaminetetraacetato Ferrate | 55 g |
| Disodium Ethylenediaminetetraacetate | 3 g |
| Acetic Acid | 8 g |
| Water to make | 1,000 ml |
| pH (25° C.) | 5.5 |
| **Stabilizing Solution** | |
| Formalin (37%) | 0.1 g |
| Formaldehyde Sulfite Adduct | 0.7 g |
| 5-Chloro-2-methyl-4-isothiazolin-3-one | 0.02 g |
| 2-Methyl-4-isothiazolin-3-one | 0.01 g |
| Copper sulfate | 0.005 g |
| Water to make | 1,000 ml |
| pH (25° C.) | 4.0 |

Each of the samples thus-processed was stored in a heat fasteners tester of 80° C. and 70% RH for 14 days to conduct a color fading test under high temperature and humidity conditions. After the fading test, the remaining density at a point where density before the test had been 1.0 was measured and it was used as a criterion of image fastness. The results obtained are shown in Table 3 below.

TABLE 3

| Sample | Coupler | Remaining Rate of Dye (%) | Remarks |
|---|---|---|---|
| 201 | (C-1) | 68 | Comparative Example |
| 202 | (1) | 88 | Present Invention |
| 203 | (2) | 89 | Present Invention |
| 204 | (3) | 90 | Present Invention |
| 205 | (6) | 92 | Present Invention |
| 206 | (10) | 93 | Present Invention |
| 207 | (15) | 89 | Present Invention |
| 208 | (17) | 91 | Present Invention |

From the results shown in Table 3, it can be seen that the coupler according to the present invention is excellent in the heat fastness.

Sample 202 was wholly exposed to white light and subjected to the color development processing according to the steps described above. From the sample, dyes formed therein were extracted and analyzed by a high speed liquid choromatograph (Chromatopack C-R4A, column TSK gel, ODS-80TS manufactured by Shimadzu Corp.). As a result, azo dyes (D-1) and (D-5) were detected and thus, it was confirmed that two kinds of dyes were formed in the film sample upon the color development processing.

While the invention has been described in detail and with reference to specific examples thereof, it will be apparent to one skilled in the art that various changes and modifications can be made therein without departing from the spirit and scope thereof.

What is claimed is:

1. A silver halide color photographic light-sensitive material comprising a support having provided thereon at least one silver halide emulsion layer, wherein the silver halide color photographic light-sensitive material contains at least one dye forming coupler represented by the following formula (I):

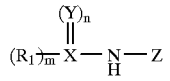

(I)

wherein $R_1$ represents a substituted or unsubstituted alkoxy group, a substituted or unsubstituted aryloxy group, a substituted or unsubstituted alkylthio group, a substituted or unsubstituted arylthio group or a substituted or unsubstituted amino group; X═Y represents C═O, C═$NR_2$, P═O or S═O; $R_2$ represents an aliphatic group or an aromatic group; Z represents a group capable of being released upon a reaction with the oxidation product of a developing agent; m and n each represents an integer of 1 or 2; $R_1$ and $R_2$, $R_1$ and Z or $R_2$ and Z may be combined with each other to form a ring; and when m is 2, two $R_1$'s may be the same or different, or may be combined with each other to form a ring.

2. The silver halide color photographic light-sensitive material as claimed in claim 1, wherein $R_1$ represents a substituted or unsubstituted alkoxy group, a substituted or unsubstituted aryloxy group or a substituted or unsubstituted amino group.

3. The silver halide color photographic light-sensitive material as claimed in claim 1, wherein X═Y represents C═O or C═$NR_2$.

4. The silver halide color photographic light sensitive material as claimed in claim 1, wherein the substituted or unsubstituted alkoxy group represented by $R_1$ is selected from the group consisting of a hexadecyloxy group, a 2-hexyldecyloxy group, a dodecyloxypropyl group and a 3-(2,4-di-tert-amylphenoxy)propyloxy group.

5. The silver halide color photographic light sensitive material as claimed in claim 1, wherein the substituted or unsubstituted aryloxy group represented by $R_1$ is selected from the group consisting of a 4-tert-octylphenoxy group, a 2,4-di-tert-amylphenoxy group and a 3-pentadecylphenoxy group.

6. The silver halide color photographic light sensitive material as claimed in claim 1, wherein the substituted or unsubstituted alkylthio group represented by $R_1$ is selected from the group consisting of a hexydecylthio group and a 2-hexyldecylthio group.

7. The silver halide color photographic light sensitive material as claimed in claim 1, wherein the substituted or unsubstituted arylthio group represented by $R_1$ is selected from the group consisting of a 4-dodecylphenylthio group and a 2-tetradecanoylaminophenylthio group.

8. The silver halide color photographic light sensitive material as claimed in claim 1, wherein the substituted or unsubstituted amino group represented by $R_1$ is selected from the group consisting of a hexadecylamino group, a dodecyloxypropylamino group, a 3-(2,4-di-tert-amylphenoxy)-propylamino group, a 4-dodecyloxyanilino group, a 3-tetradecanoylaminoanilino group, a 2-methoxy-5-tetradecanoylaminoanilino group, an N-methyl-N-hexadecylamino group and an N-methyl-N-(4-dodecyloxyphenyl)amino group.

9. The silver halide color photographic light sensitive material as claimed in claim 1, wherein the amount of the coupler of formula (I) is from $1\times10^{-3}$ to 1 mol per mol of silver halide.

10. A silver halide color photographic light-sensitive material comprising a support having provided thereon at least one silver halide emulsion layer, wherein the silver halide color photographic light-sensitive material contains at least one dye forming coupler represented by the following formula (I):

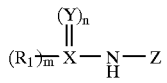

(I)

wherein $R_1$ represents a substituted or unsubstituted aliphatic group, a substituted or unsubstituted aromatic group, a substituted or unsubstituted heterocyclic group, a substituted or unsubstituted alkoxy group, a substituted or unsubstituted aryloxy group, a substituted or unsubstituted alkylthio group, a substituted or unsubstituted arylthio group or a substituted or unsubstituted amino group; X═Y represents C═O, C═$NR_2$, P═O or S═O; $R_2$ represents an aliphatic group or an aromatic group; Z represents a halogen atom, an alkoxy group, an aryloxy group, an acyloxy group, a sulfonyloxy group, an acylamino group, a sulfonamido group, an alkoxycarbonyloxy group, a carbamoyloxy group, an alkylthio group, an arylthio group, a heterocyclic thio group, a heterocyclic oxy group, a 5-membered or 6-membered nitrogen-containing heterocyclic group or an azo group; m and n each represents an integer of 1 or 2; $R_1$ and $R_2$, $R_1$ and Z or $R_2$ and Z may be combined with each other to form a ring; and when m is 2, two $R_1$'s may be the same or different, or may be combined with each other to form a ring.

11. The silver halide color photographic light sensitive material as claimed in claim 10, wherein the substituted or unsubstituted aromatic group represented by $R_1$ is selected from the group consisting of a 4-dodecyloxyphenyl group, a 4-tetradecanoyl-aminophenyl group and a 2,4-di-tert-amylphenyl group.

12. The silver halide color photographic light sensitive material as claimed in claim 10, wherein the substituted or unsubstituted heterocyclic group represented by $R_1$ is selected from the group consisting of a 5-dodecyloxy-carbonyl-2-furyl group and a 2-hexadecanoylamino-5-pyridyl group.

13. The silver halide color photographic light sensitive material as claimed in claim 10, wherein the substituted or unsubstituted aliphatic group represented by $R_1$ is selected from the group consisting of an octyl group, a 2-ethylhexyl group, a dodecyl group, a hexadecyl group, a tert-octyl group, an isodecyl group, an isostearyl group, a dodecyloxypropyl group and a 3-(2,4-di-tert-amylphenoxy)propyl group.

14. The silver halide color photographic light-sensitive material as claimed in claim 13, wherein Z represents a chlorine atom, an aryloxy group, a heterocyclic oxy group, a carbamoyloxy group or a 5-membered nitrogen-containing heterocyclic group.

15. The silver halide color photographic light-sensitive material as claimed in claim 14, wherein Z represents an aromatic oxy group, a heterocyclic oxy group or a nitrogen-containing heterocyclic group.

* * * * *